United States Patent [19]

Wei

[11] 4,364,998

[45] Dec. 21, 1982

[54] SPUNLIKE YARNS

[75] Inventor: Lun-Yan Wei, Newark, Del.

[73] Assignee: E. I. Du Pont de Nemours and Company, Wilmington, Del.

[21] Appl. No.: 285,023

[22] Filed: Jul. 20, 1981

[51] Int. Cl.[3] ..... D02G 3/00

[52] U.S. Cl. ..... 428/399; 57/248; 57/907; 428/397; 428/400

[58] Field of Search ..... 428/364, 373, 399, 397, 428/400; 28/271, 273; 57/206, 248, 907

[56] References Cited

U.S. PATENT DOCUMENTS

| | | | |
|---|---|---|---|
| 3,177,557 | 4/1965 | White . | |
| 3,242,035 | 3/1966 | White . | |
| 3,506,535 | 4/1970 | Prevorsek et al. | 428/397 X |
| 3,864,903 | 2/1975 | Maki | 57/907 |
| 3,884,030 | 5/1975 | Baxter et al. | 428/397 X |
| 4,100,725 | 7/1978 | Magel . | |
| 4,245,001 | 1/1981 | Phillips et al. . | |
| 4,259,393 | 3/1981 | Marco | 428/397 X |

*Primary Examiner*—Lorraine T. Kendell

[57] ABSTRACT

Spunlike yarns having free ends are made from continuous filament yarn by fluid-jet texturing. The fibrous elements that make up the yarn have irregular and varying cross-sectional shapes, said fibrous elements being forked and merged in a fortuitous manner. The spunlike yarns may also contain fibrous elements that extend substantially continuously throughout the length of the yarn.

8 Claims, 14 Drawing Figures

SPUNLIKE YARNS

BACKGROUND OF THE INVENTION

This invention relates to yarns made up of synthetic polymer fibrous elements. The yarns feel similar to spun yarns made from natural fibers.

It is known in the jet texturing art to product yarns of synthetic polymer filaments which are entangled throughout their length and contain nodes and splayed sections. Such yarns may contain broken filaments that extend out of the yarn surface and give the yarn a more "natural" feel—See U.S. Pat. No. 4,100,725 to Magel. It is also known to produce yarns of synthetic polymer filaments in which the individual filaments are made up of a body portion and at least one wing portion, and in which the wing portion is intermittently separated from the body portion for part of the length of the filament. In these yarns the wing portion at least occasionally is fractured in the transverse direction and is intermingled and entangled with neighboring portions while still attached at one end to the body portion, thus yielding a yarn having a number of continuous body portions that are never fractured, and a number of wing portions that often fracture and thus produce free ends—See U.S. Pat. No. 4,245,001 to Bobby M. Phillips et al.

SUMMARY OF THE INVENTION

The present invention is a yarn that has the luxurious feel of a spun yarn and may, if desired, be low in pilling. The yarns of the present invention contain a plurality of synthetic polymer fibrous elements of irregular and varying cross section, that is, the fibrous elements do not have the same cross-sectional shape or cross-sectional area throughout their length, and although the same shape and area may recur in different fibrous elements in a cross section through the yarn, the cross section of a particular fibrous element will change within a relatively short length—usually within a few centimeters. The fibrous elements that make up the yarns of this invention are forked and merged in a fortuitous manner—i.e., large fibrous elements split longitudinally into smaller fibrous elements and small fibrous elements combine longitudinally into larger fibrous elements. At least occasionally, some of the fibrous elements merge to form a fibrous element that has a "C" cross-sectional shape or a fibrous element that requires more than four straight lines to trace its perimeter, for example, a "T", "X", "Y" or "V" cross-sectional shape. Fibrous elements having an occasional "C" cross-sectional shape would result from using a spinneret orifice like FIGS. 7 and 8, while fibrous elements having an occasional "T", "X", "Y" or "V" cross-sectional shape would result from using selected spinneret orifices from FIGS. 2 to 6. Some of the fibrous elements are fractured transversely and protrude as free ends. The number of free ends is in the range of 10 to 150 per centimeter (25 to 380 per inch) of yarn length, and the yarns have a linear density of 3 to 1100 tex (27 to 10,000 denier). The cross sectional area and cross-sectional shape of most of the fibrous elements in the yarn cross section are of approximately the same cross-sectional area and cross-sectional shape as those fibrous elements that terminate in free ends; and those fibrous elements that do not have approximately the same area and shape are forked to form fibrous elements of approximately the same area and shape. Many of the fibrous elements in the yarns have at least one ragged side that extends parallel to the longitudinal dimension of the fibrous elements. The ragged sides are formed when the filaments split longitudinally to form the fibrous elements. The fibrous elements are frequently entangled along the length of the yarn. In some of the yarns, the fibrous elements are loosely entangled, with many intertwined fibrous elements which are disposed in the same direction as the axis of the yarn or at small angles with respect to it. In many yarns, the entanglement is such that the yarns have consolidated sections—such as nodes and wrapped sections—which stabilize the yarn, similar to the stabilization of spun yarns by twist. In some yarns, the fibrous elements are in places entangled tightly as nodes and wrapped sections which usually cannot be pulled apart and within which fibrous elements are sometimes disposed at rather large angles with respect to the axis of the yarn. Some yarns have both tightly entangled nodes and loosely entangled intertwined sections. Some of the yarns of this invention have nodes or wrapped sections that entangle substantially all the fibrous elements of the yarns, and other yarns have nodes that entangle only a portion of the fibrous elements of the yarn. Between consolidated sections in any of these yarns, splayed sections with little or no entanglement may exist.

If it is desired to produce a product that has low tendency to pill, the yarn can be so fabricated to yield that result. The tendency of a fabric to pill is caused by the yarn having free ends that are too long, and thus are able to entangle with other free ends at the surface of the fabric and form pills. The length of the free end that sticks out above the surface of the fabric is significant as a cause of pilling. Thus the portion of a free end that is tucked into the yarn at a node or wound into a splayed section does not cause pilling. Pilling can therefore be reduced by increasing the number of nodes per given length of yarn. Pilling can also be reduced by preparing a yarn in which the fibrous elements have relatively low strength. In such a yarn the free ends break off when pills start to form. Such yarns are formed from polymers that have molecular weights in the lower end of the fiber-forming range. It follows that the degree of pilling can be regulated by proper selection of polymer and by proper selection of the degree of node formation.

The yarns of the present invention may also include up to 90% by weight of filaments that are not fractured transversely, or which contain a portion of filament cross section which is seldom fractured even if the remainder of the cross section is subject to splitting and fracturing. These filaments, when present in the yarn of the invention, are designated as "companion members". They may be included if a yarn of firmer hand or greater strength is desired. Companion members may be produced from the same spinneret as the filaments that split and fracture by using capillaries of different shape, or by blending filaments made from different spinnerets. Such companion members may be of round or multilobal cross section or of any other cross section that is more stable in a texturing jet than the filaments that split longitudinally in the jet. Such companion members, because they do not readily split longitudinally, may have smooth sides rather than ragged sides. Such companion members may also differ in chemical composition from the forked fibrous elements—they may be of a different polymer composition, for example, a polyamide in otherwise polyester yarn, or they may be of a higher molecular weight. Companion members may also be included which do split longitudinally, but which do not fracture and form no free ends. Companion members of the latter type have ragged sides but no free ends. Companion members may also be fibrous elements that have body portion and a wing portion, and the wing portion is occasionally split from the body portion. The wing portion may occasionally end in a free end. Yarns of this invention containing such companion members invariably have consolidated sections and splayed sections to properly unite the forked and merged fibrous elements with the companion members while maintaining the spunlike character of the yarn.

A cross-sectional microscopic study of a yarn of the invention shows that the fibrous elements that make up the yarn differ widely in area and shape, and the number of fibrous elements shown in a cross section also varies. In general, the number of fibrous elements seen in a cross section of yarn of this invention will be in the range of about 20 to 1200, and the area of a fibrous element seen in cross section will vary between about 5 sq. micrometers and about 250 sq. micrometers.

DRAWINGS

DETAILED DESCRIPTION

Figure 1:
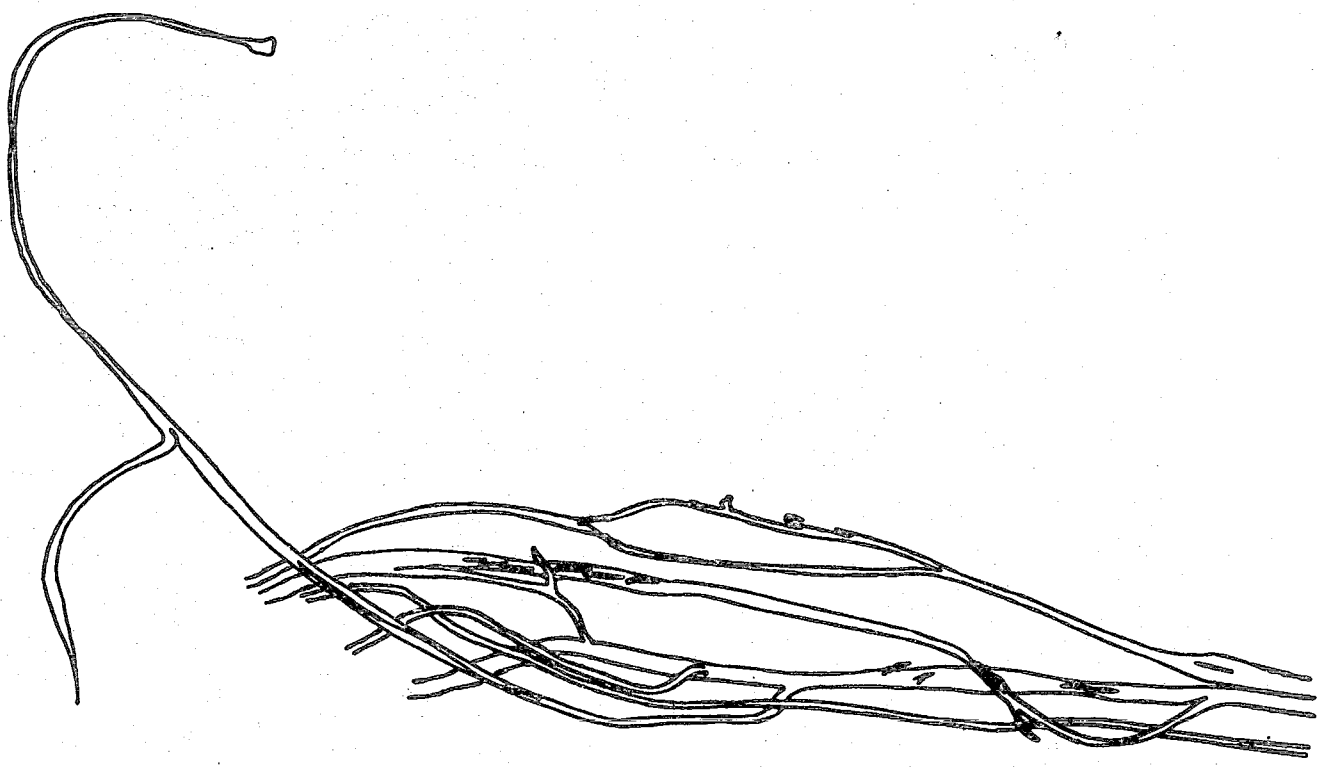
FIG. 1 is a drawing of a portion of yarn showing fibrous elements that were obtained by the jet splitting and fracturing of a particular filament.

The yarns of the present invention are made from feed yarns produced by spinning filaments of a cross section that is splittable longitudinally when the filaments are passed through a texturing fluid jet. The cross sectional shape of the filaments should be selected such that there is no portion of the cross section that is significantly stronger than any other portion; so that the filament when subject to the action of a texturing jet will split fortuitously in a longitudinal direction and each of the portions have a reasonable likelihood of fracturing transversely and thus forming free ends. Numerous different filament cross sections have been employed successfully. FIGS. 2–8 illustrate some of various spinneret orifices that can be employed to give a filament that may be processed to yield yarns of the invention.

The degree of longitudinal and transverse splitting of the spun filaments obtained by passing the filaments through a texturing jet depends inter alia on the jet design, on the amount of overfeed of the filament to the jet, on the pressure of the fluid that is fed to the jet, and on the composition, molecular weight, degree of orientation, and size and shape of the filament; however such factors are readily determined by trial and error.

A suitable jet for use in producing the yarns of the present invention is that disclosed in Agers U.S. Pat. No. 4,157,605 issued June 12, 1979. Other suitable jets for use in producing the yarns of the present invention are the jets shown in FIG. 7 and listed in Table Y of British Pat. No. 1,558,612. Filaments made of synthetic polymers such as terephthalate polyesters, polyamides, acrylonitrile polymers and polyolefins are especially suitable for producing the yarns of the present invention. The polymer should be of suitable fiber-forming molecular weight. There is a relationship between molecular weight and the tendency of filaments spun through a nonround spinneret to become round due to surface tension. Higher molecular weight polymers retain the nonround configuration better than lower molecular weight polymers. Terephthalate polyester polymers having relative viscosities (measured in hexafluoroisopropanol) in the range of about 8 to 28 are suitable for use in the present invention. Low pilling through wear off is achieved in the 8 to 11 range.

TESTS

The yarns of this invention have certain structural elements that are perceived by the following procedures:

TEST I. LONGITUDINAL EXAMINATION OF TEST YARN

The longitudinal structure of the test yarn is observed by examination of a sample of the yarn under a scanning electron microscope (SEM). A suitable instrument for examining samples of the test yarns is a conventional scanning electron microscope having a nominal magnification range of 10×–240,000× with a resolution of 7 nm, such as the ETEC "Autoscan" SEM, manufactured by ETEC Corporation, Hayward, Calif.

Yarn samples about 2.5 cm (1 inch) long are mounted on a sample holder. The sample holder is placed in a high vacuum evaporator provided with a sputter module, such as the Model DV-502 evaporator equipped with a DSM-5 cold sputter module, manufactured by Denton Vacuum, Inc., Cherry Hill, N.J., and a thin coating of gold is deposited on the surface under a vacuum of approximately $10^{-5}$ torr. The electrical conductivity of the gold-coated sample is enhanced by applying a coating such as a suspension of graphite in isopropanol at each end of the mounted sample which contacts the sample holder. The sample holder is then placed in the SEM and positioned for observation at a tilt angle of 0° (electron beam perpendicular to yarn sample). The SEM is set for observation at low magnification, preferably 10×–30×. Observation is begun at one end of the yarn sample and the sample is slowly traversed to the other end, taking a sufficient number of photomicrographs as the yarn is traversed so that all of the yarn is photographed. A montage of the photomicrographs is then prepared showing the structure of the yarn from one end of the yarn sample to the other. The montage is examined to ascertain the presence of the following structural elements:

(1) yarn formed of a plurality of fibrous elements;
(2) forking and merging of the fibrous elements of the yarn;
(3) ragged sides extending longitudinally of the fibrous elements (e.g., ragged sides beginning at a fork and visible on the smaller fibrous elements extending therefrom);

(4) frequent entanglement of the fibrous elements with one another; and (5) fibrous elements terminating as free ends.

If not all of the above structural elements can be seen readily in the montage, additional photomicrographs at higher magnification are taken from the sample of yarn mounted on the sample holder, using the montage as a guide for selecting areas of the sample for further examination.

If the presence of any of the above structural elements remains unresolved after the above examinations, another sample of the test yarn is placed under a stereo-optical microscope and examined under various magnifications. The yarn is cut through at one side of a consolidation point of high entanglement so as to allow the fibrous elements to splay back to the next consolidation point and permit the fibrous elements to be visualized more clearly. If necessary, individual fibrous elements or small groups of fibrous elements are cut free and mounted on a sample holder for examination under the SEM for final verification of the presence of the structural elements enumerated above.

TEST II. SHAPE COMPARISON TEST

This test is employed to determine whether the fibrous element cross sections and parts thereof found in a cross section of a yarn being tested are also found in the cross sections of the free ends of the yarn. All portions of the fibrous element cross sections observed in the yarn cross section are normally also found in the free end cross sections of the yarns of the invention. In those yarns of the invention wherein companion members are present, at least a portion of the cross section of the companion member may not be found at all in the cross sections of the free ends. The following test also provides for the identification of such companion members in the yarns of the invention.

A. Identifying and Removing Large Free Ends

In this procedure, large free ends projecting from the test yarn are identified and removed from the yarn for detailed examination. A "large" free end is defined as a free end which, at some point between its tip (or tips) and the place from which it projects from the main yarn bundle, has a large diameter (or width) as compared with the diameters (or widths) of most other free ends projecting from the yarn. These ends frequently exhibit forking and merging.

A representative sample, 30 cm (12 in) in length, is cut from the supply of test yarn and placed on a flat surface, which is then positioned for observation under a stereo-optical microscope at magnifications in the range of about 25–80×. The entire length of the sample is first scanned to obtain a visual impression of the free end structure of the yarn. The sample is then scanned a second time to compare the sizes of the free ends projecting from the yarn and to provide a basis for discriminating large free ends from smaller free ends.

Each of the large free ends which is to be examined is removed from the test yarn and prepared for embedding and sectioning as follows. After a large free end is identified, selected for removal, and observed for evidence of forking or merging, one end of a small diameter probe is wetted with adhesive and the wetted end is brought into contact with the tip of the free end so that the free end adheres to the probe. When the free end has more than one tip, the tip projecting furthest from the yarn is contacted; two or more closely-spaced tips may be contacted simultaneously by the probe. The adhesive is then allowed to harden so that a joined structure of the probe and free end is formed. The probe is then gently pulled to tension the free end with respect to the yarn bundle from which it projects. When the free end is tensioned, it may be pulled out slightly further from the yarn bundle than it originally was. The free end is then severed from the sample as close as possible to the yarn bundle by cutting off the free end with a pair of very finely pointed scissors. The exact point of the cut is not critical, but it should be on the outer side of any forked or merged point which is pulled out from the yarn when the free end is tensioned.

If forking or merging of fibrous elements was observed in the large free end before it was severed, the procedure in the remainder of this paragraph may be omitted. If not, the severed large free end is placed under an ordinary optical microscope at a magnification of about 700×. If it is seen that forking occurs within the free end, or if a portion of the longitudinal surface of the free end is seen to be a ragged edge, the large free end and the probe to which it is attached are processed as described in the next paragraph. Otherwise, the severed large free end is prepared for examination under the scanning electron microscope by mounting it and coating it as in Test I with gold metal. The free end is scanned along its entire length. If forking is observed, or if a portion of the surface is seen to be a ragged edge, the large free end and the probe to which it is attached is removed from the sample holder and processed as described in the next paragraph. Otherwise, the large free end is discarded and another large free end in the test yarn is selected to replace it in the test. The replacement free end is selected and prepared by the same procedure used for all the other large free ends.

The severed large free end, held by the probe to which it is joined, is placed on a surface of polytetrafluoroethylene (PTFE) and the probe is taped to the PTFE. A second probe is then wetted with adhesive, brought into contact with the severed free end along the line of the cut, and maintained in contact while the adhesive hardens so that the second probe adheres to the free end opposite the first probe. The free end is then gently tensioned to straighten it and the second probe is taped to the PTFE surface. Additional adhesive is then placed on the free end in sufficient quantity (usually a drop or two) to cover the free end, including its points of attachment to the probes. The assembly of the free end and attached probes, stiffened and supported by the additional adhesive, is then removed from the PTFE, placed in an encapsulating mold and embedded in epoxy resin.

B. Preparing Cross Sections of the Free Ends

The embedded free end sample, prepared by the method described above, is placed in a microtome and a wafer 5 to 10 micrometers in thickness is cut off near one point of attachment of the free end to a probe. The wafer is examined under a microscope to determine whether the free end section is unitary or consists of two or more parts. If the section is not unitary, or if it appears that the maximum cross-sectional area of the free end is not contained in the first wafer, additional wafers are cut. Cutting of wafers is continued until a wafer is obtained which contains a unitary cross section which appears to be substantially the maximum cross-sectional area of the free end, or until all of the free end is sectioned. Also, if it has been observed that the free end is forked one or more times, sufficient wafers are cut to disclose representative sections. All of the wafers and any remainder of the embedded free end sample are suitably identified and saved.

After the first large free end has been embedded and sectioned, the procedure is repeated until a fair sample (at least 10) large free ends have been embedded in turn, with one or more wafers prepared from each embedded free end.

C. Evaluation of Large Free Ends

All of the wafers prepared as described in Part B for a set of at least 10 of the large free ends are placed, in turn, upon a slide under a microscope appropriately equipped for graphic analysis with video display of the images contained in the wafer on a screen, the microscope being appropriately connected to a video-amplifier, a reading head with a cursor for tracing images on the screen, a computer programmed to calculate areas of cross sections traced on the screen, and a printout facility. Suitable commercially available equipment such as Quantimet Image Analyser, made by Cambridge Instruments, or Omnicon made by Bausch and Lomb may be used. Using a magnification suitable for viewing all parts of the free end cross sections in each of the wafers, the boundaries of each cross section in each of the wafers is traced, in turn, with the cursor. The same magnification is maintained for tracing all of the cross sections. A printout of data regarding the relative areas of the cross sections which have been traced is obtained. For each free end of the set of at least 10 free ends the highest value found for relative area of cross section is then identified, and a list of these highest values is then made, ranked in descending order of size.

The first member of the list is designated $A_L$, the largest of any of the cross-sectional areas in the set of at least 10 free ends. Excluding $A_L$, the average relative cross-sectional area of the highest one-third (designated $A_H$) of the remaining cross-sectional areas in the list is determined. If the statistical criterion is met that $A_L$ is less than 50% greater than $A_H$, the set of free ends is suitable for further testing and the rest of this Part C of the test may be omitted. However, if $A_L$ is at least 50% greater than $A_H$, the free end corresponding to $A_L$ is removed as statistically not representative and none of its wafers is used for further comparisons. Another large free end (embedded, sectioned, and graphically analyzed at the same magnification) is added to the remaining large free ends to form a new set of free ends, and a new list of highest values of cross-sectional areas for each of the free ends, ranked in order of descending size, is made.

The procedure in the above paragraph is repeated until a set of free ends is obtained in which the statistical criterion is met, or until the number of free ends added to replace those removed exceeds one-third the number of free ends in the original set. When this occurs, all of the removed free ends are returned to form an enlarged set. The procedure is repeated with the enlarged set until the statistical criterion is met.

D. Preparing Test Yarn Sections

A sample of the test yarn is placed in an encapsulation mold, gently tensioned, and embedded in epoxy resin. The embedded sample is placed in a microtome and sectioned, perpendicular to the yarn, at a location at which the fibrous elements are fairly well separated and reasonably parallel. A wafer 5 to 10 micrometers in thickness is cut and examined under the microscope to determine whether most of the fibrous element cross sections have distinct boundaries; if many of the fibrous elements cross sections are blurred, several such wafers are prepared and the one which contains the highest proportion of cross sections with distinct boundaries is selected for further examination. This wafer is designated as the "Reference Wafer". The embedded sample as well as all wafers cut from it are saved.

E. Comparison of Cross-sectional Shapes

A photomicrograph of the test yarn section embedded in the Reference Wafer is made, the magnification of the photomicrograph being sufficient (usually about 700×) to see the cross sections of all the fibrous elements clearly. The individual cross sections of the fibrous elements are numbered or otherwise suitably identified on the photomicrograph, which is designated as the "Reference Photomicrograph." The total number of individual cross sections of fibrous elements in the Reference Photomicrograph is recorded.

The Reference Wafer is then placed upon a slide under a microscope equipped for graphic analysis and the boundaries of all of the fibrous element cross sections in the wafer are traced, using the same magnification employed in Part C above. The number (or other identification) assigned to each fibrous element cross section on the Reference Photomicrograph is recorded as its cross section is traced. A printout of data regarding the relative areas of the cross sections which have been traced, including appropriate identification of each item of data, is obtained.

All of the wafers made for each large free end from the set of free ends remaining at the conclusion of Part C above (more than one wafer for a given free end if more than one was prepared) are brought out and the cross sections of the fibrous elements on the Reference Photomicrograph are compared in sequence with the free end cross sections. Each fibrous element cross section is evaluated as described below and classified as to whether or not it has a matching free end.

The following criteria are used for evaluating the fibrous elements:

(1) The particular fibrous element cross section which is being evaluated is first compared with the free end cross sections found in the wafers prepared according to Part B and evaluated according to Part C. In this comparison, the particular fibrous element cross section in the Reference Photomicrograph is compared with the free end cross sections in turn until one is found which substantially matches the shape of the fibrous element cross section, or until all the free end cross sections have been observed without finding one which substantially matches the fibrous element cross section. Mirror images are counted as the same shape. If a free end cross section is found which substantially matches the shape of the fibrous element cross section, the relative areas of the two cross sections are compared to determine whether they are approximately the same, i.e., differ by less than a factor of two. The irregular nature of the splitting can give a variation in area for a shape. If the shapes substantially match and the areas are also approximately the same, the fibrous element is rated as having a matching free end. The next and succeeding fibrous element cross sections are then subjected to the same comparison procedure. Two or more fibrous element cross sections may be matched with the same free end cross section. If there is such a large variety of cross-sectional shapes in the Reference Photomicrograph that some of them cannot be matched with the free end cross sections even though their relative areas are approximately the same, the set of at least 10 free ends should be enlarged. Small free ends, as well as large free ends, should be included in the enlarged set. The number of fibrous elements in the Reference Photomicrograph having matching free ends, as determined by the procedure of this paragraph, is noted. If there are extremely small cross sections in the Reference Photomicrograph, but which are too small to be considered approximately the same in area, these small cross sections are considered to be statistically insignificant if they number less than 3% of the total number of fibrous elements in the Reference Photomicrograph, and such a small number of small cross-sectional area fibrous elements is deemed to have a matching free end. Otherwise they and any other fibrous elements for which no matching free end cross section can be found is next evaluated by criterion (2) below. If all of the fibrous element cross sections in the Reference Photomicrograph are found to have matching free ends by criterion (1) above, the test is complete.

(2) If any fibrous element (or elements) is found which has no matching free end, additional wafers of the embedded sample of the test yarn are cut adjacent to the location from which the Reference Wafer was cut, and photomicrographs at about 700× are prepared from the wafers. The photomicrographs are examined to determine whether the fibrous element (or elements) observed in the Reference Photomicrograph (and found to have no matching free end) forks into two or more smaller fibrous element cross sections, remains intact, or merges with other fibrous elements. If forking or merging to form cross sections different from those of the Reference Photomicrograph is observed, the different cross sections are compared with the free end cross sections as in criterion (1) above, and if matching cross sections are found for each of the different cross sections, the corresponding fibrous element (or elements) in the Reference Photomicrograph is rated as having matching free ends.

(3) Fibrous elements in the Reference Photomicrograph which remained intact in the wafers adjacent to the Reference Wafer when examined in the preceding paragraph, but which have substantially the same shape and area as those fibrous elements which were rated by criterion (2) as having matching free ends, are likewise rated as having matching free ends.

(4) If any fibrous element cross section is found in the Reference Photomicrograph which remains intact through 20 or more successive wafers (each wafer is about 5 to 10 micrometers thick), and differs substantially in shape or area from all fibrous element cross sections in the Reference Photomicrograph which have matching free ends or are observed to split or merge in nearby wafers to form cross sections which have matching free ends, a sample of the test yarn is placed under a stereo-optical microscope at a magnification suitable for observing the individual fibrous elements. The yarn is examined with the objective of identifying the fibrous element in the Reference Photomicrograph which remains intact through 20 or more successive wafers. When a fibrous element in the test yarn is found which appears to correspond to it, other fibrous elements are teased away from it and it is examined over as long a distance as possible (preferably several centimeters) to determine whether there is any evidence that the fibrous elements is forked or merged in some portions of its length into smaller or larger fibrous elements. Also, it is examined to determine whether it has a continuous, relatively smooth surface or whether a portion of its surface is ragged. If the surface of the fibrous element cannot be definitely characterized as smooth or ragged by observation under the stereo-optical microscope, it is further examined under the scanning electron microscope. A sample of the fibrous element at a nonforked location is embedded and sectioned, and its cross section is compared with the Reference Photomicrograph to verify that the sample of the fibrous element corresponds to the fibrous element which remains intact through successive wafers (if not, the sample is discarded and the procedure repeated until an appropriate sample of the intact fibrous element is found). If it is observed that the sample of the fibrous element is forked in some portions of its length, a forked location of the sample is also embedded and sectioned, and the forked cross sections are compared with the free end cross sections as in criterion (1) above. If matching free ends are found for all parts of the forked cross sections, the fibrous element (or elements) which is forked in some portions of its length is rated as having matching free ends. If any part of the forked fibrous elements are found to have no matching free ends, they are next evaluated by criterion (7) below. If no evidence of forking was found, the fibrous element which was found to be intact through successive wafers is next evaluated by criterion (5) below if it has a continuous, relatively smooth surface and by criterion (6) if a portion of its surface appears ragged.

(5) If any fibrous element (or elements) is found in the Reference Photomicrograph which remains intact through successive wafers, and the fibrous element has a continuous, relatively smooth surface with no evidence of any forking or merging when examined longitudinally under a stereo-optical microscope, single cross sections of the test yarn are made at three locations well separated from each other and from the location of the Reference Wafer. If the presence at these other locations of the cross section of the fibrous element (or elements) which remains intact through successive wafers is confirmed, it is rated as a nonforked companion member; otherwise, the sequence in criteria (4) and (5) are repeated until the nature of this fibrous element is established.

(6) If a portion of the surface of the fibrous element which remains intact through successive wafers appears to be ragged, the fibrous element is followed in either or both longitudinal directions to find a place where it merges with another fibrous element. If such a place is found, the two fibrous elements which merge are considered as forked fibrous elements and are evaluated by criterion (7) below. If the fibrous element with the ragged surface cannot be followed far enough to find a place where it merges with another fibrous element, similar fibrous elements with ragged edges are located in other sections of the yarn and examined longitudinally to determine whether they merge with other fibrous elements and should be considered as forked fibrous elements. If no evidence of forking or merging is found, single cross sections of the test yarn are made at three locations well separated from each other and from the location of the Reference Wafer. If the presence at these other locations of the cross section of the fibrous element (or elements) which remains intact is found, the fibrous element (or elements) which remains intact through successive wafers and has a ragged surface is rated as a nonforked companion member. The Reference Photomicrograph and the photomicrographs of adjacent wafers are again examined, and the number of fibrous elements having a ragged surface and remaining intact through successive wafers is noted.

(7) If any fibrous element is found which is forked in some portions of its length, and yet no matching free ends can be found corresponding to the forked portions of the fibrous element, a sample of the test yarn is placed under a stereo-optical microscope as in criterion (4) above. The yarn is examined until a fibrous element is found which appears to correspond to the forked fibrous element seen in the series of adjacent wafers (and for which no matching free end was found). Other fibrous elements are teased away from it, and it is examined over as long a distance as possible (preferably several centimeters) to determine whether any free ends are attached to it. Samples are embedded at both forked and nonforked locations to check that a fibrous element having the correct cross section has been identified. If there are no free ends attached to the fibrous element and it is not further forked, it is rated as a forked companion member with no free end attachments. If evidence of further forking of this fibrous element was noted, it is reevaluated in accordance with criterion (2) for matching free ends in the further forked areas.

(8) If the fibrous element evaluated by the procedure of criterion (7) does have free ends but is not further forked, it is rated as a forked companion member with free end attachments.

When it has been determined that the yarn contains companion members, and if it is desired to know the percent by weight of companion members in the yarn, a section of yarn is selected—preferably between nodes—the fibrous elements are separated microscopically, weighed, and the percent of companion members calculated.

TEST III. FREE END COUNT PER UNIT LENGTH

A sample of yarn about 35 cm (14 in) long is cut from the test yarn. The yarn is placed longitudinally along the centerline of a clear plastic straight edge marked off in 1 cm segments. With the yarn positioned so that it is lying straight but not under tension, both ends of the yarn are taped to the straight edge, after which the yarn is covered by placing a second clear plastic straight edge over the first one, with the two straight edges in alignment. The yarn is viewed on a shadowgraph (e.g., Wilder Varibeam, Optometric Tools, Inc., Rockleigh, N.J., 07647 or Nippon Kogaku K. K., Japan, Model 6) at 20× magnification, and the measurements are made on the screen on which the yarn image is projected. Through 30 cm (12 in) of yarn length, the number of free ends in each 1 cm segment is counted and recorded.

The following calculation is made from the data obtained:

$$\text{Free ends/cm} = \frac{\text{Number of free ends counted in 30 cm}}{30}$$

Other Tests

The relative viscosity of the polyester, designated in the examples as "HRV" (acronym for Hexafluoroisopropanol Relative Viscosity) is determined as described by Lee in U.S. Pat. No. 4,059,949, Column 5, line 65 to Column 6, line 6.

Conventional physical test methods are employed for determination of linear density, tenacity, and elongation of the yarns. Lea Product and skein breaking tenacity are measures of the average strength of a textile yarn and are determined in accordance with ASTM procedure D1578 (published 1979) using standard 80-turn skeins.

Fabric pilling propensities are evaluated on the "Ramdom Tumble Pilling Tester" described by E. M. Baird, L. C. Legere, and H. E. Stanley in Textile Research Journal, vol. 26, pages 731–735 (1956). The following scale of pill level ratings is employed in evaluating fabrics in this test:

5.0—no pilling
4.0—slight pilling
3.0—moderate pilling
2.0—heavy pilling
1.0—severe pilling Intermediate ratings within the above values are assigned to the nearest 0.1 unit to place fabrics in their proper rank in the above scale. Three samples of each fabric are rated. The ratings are averaged.

EXAMPLE I

Figure 7:
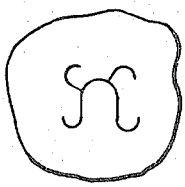
Figure 8:
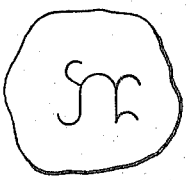
Figure 9:
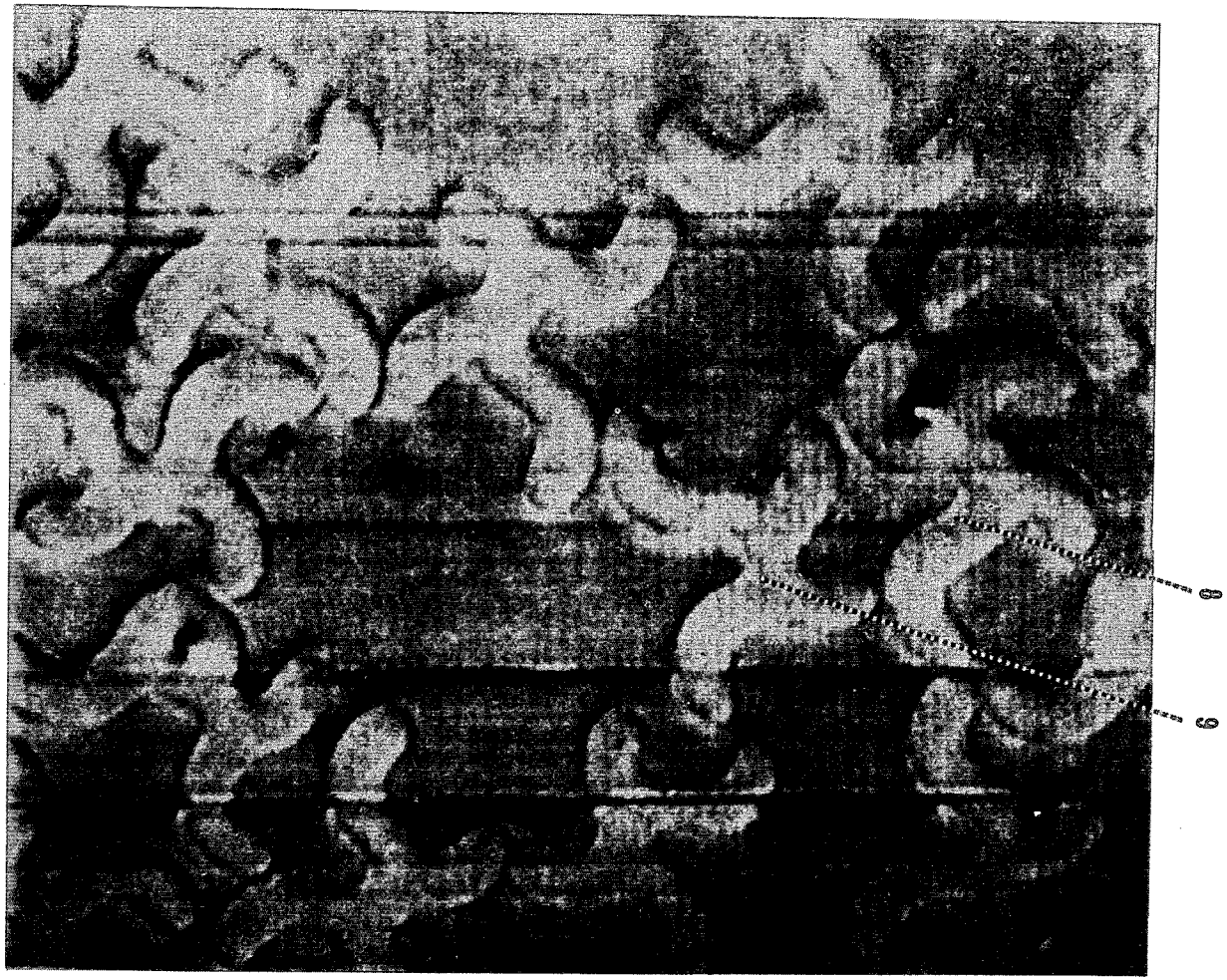
FIG. 9 is a photomicrograph of the cross sections of feed yarn filaments extruded from spinneret orifices having the configuration of FIG. 7 and its mirror image.

Poly(ethylene terephthalate), having an HRV of about 23 and containing 0.3 wt. % $TiO_2$ as a delusterant, was spun at a spinneret temperature of 265° C. from a 34-hole spinneret in which 17 holes had the configuration shown in FIG. 7 and the other 17 had the mirror image configuration. In each hole the central arc was a slot 0.0089 cm (0.0035 in) wide having its inner edge sweeping through 225° of a circle having a radius of 0.037 cm (0.0145 in), while the outer arcs were slots 0.010 cm (0.004 in) wide with the inner (shortest) edge of each slot being on a circle having a radius of 0.025 cm (0.010 in). Cross-flow quenching air was passed across the extruded filaments in such a way that it first contacted each filament between the middle two outer arcs. The filaments were gathered by guides into a yarn (hereafter designated as the "feed yarn"), passed to a roll operating at a peripheral speed of 3000 mpm (3281 ypm), and wound up on a package at 2923 mpm (3197 ypm). A photomicrograph of the cross section of the feed yarn filaments is shown in FIG. 9.

The feed yarn was passed from its windup package at a peripheral speed of 176 mpm (192 ypm) over a 1-meter (1.1-yd) long hot plate maintained at 180° C. to a draw roll operated at a peripheral speed of 300 mpm (328 ypm) and thence through a jet device and wound up under constant tension as a package of yarn (hereafter designated as the "textured yarn") at a peripheral speed of 285 mpm (312 ypm). The jet device was like that shown in FIGS. 6 and 7 of U.S. Pat. No. 4,157,605 (reference characters in the remainder of this paragraph being to FIG. 7 of that patent), except that the cylindrical baffle 40' was omitted and the yarn was passed vertically downward upon leaving the venturi 58. The yarn needle exit 57 had an inside diameter of 0.102 cm (0.040 in), and at its narrowest point the diameter of the exit passage of venturi 58 was 0.178 cm (0.070 in). The jet device was supplied with air at 1379 kPa (200 psi). The yarn needle was initially advanced to the fully closed position and was then backed off until the cross-sectional area of the annular restriction B was about equal to the cross-sectional area at its narrowest point of the exit passage of venturi 58; the cross-sectional area of orifice 72 being substantially larger than that of annular restriction B.

Figure 10:
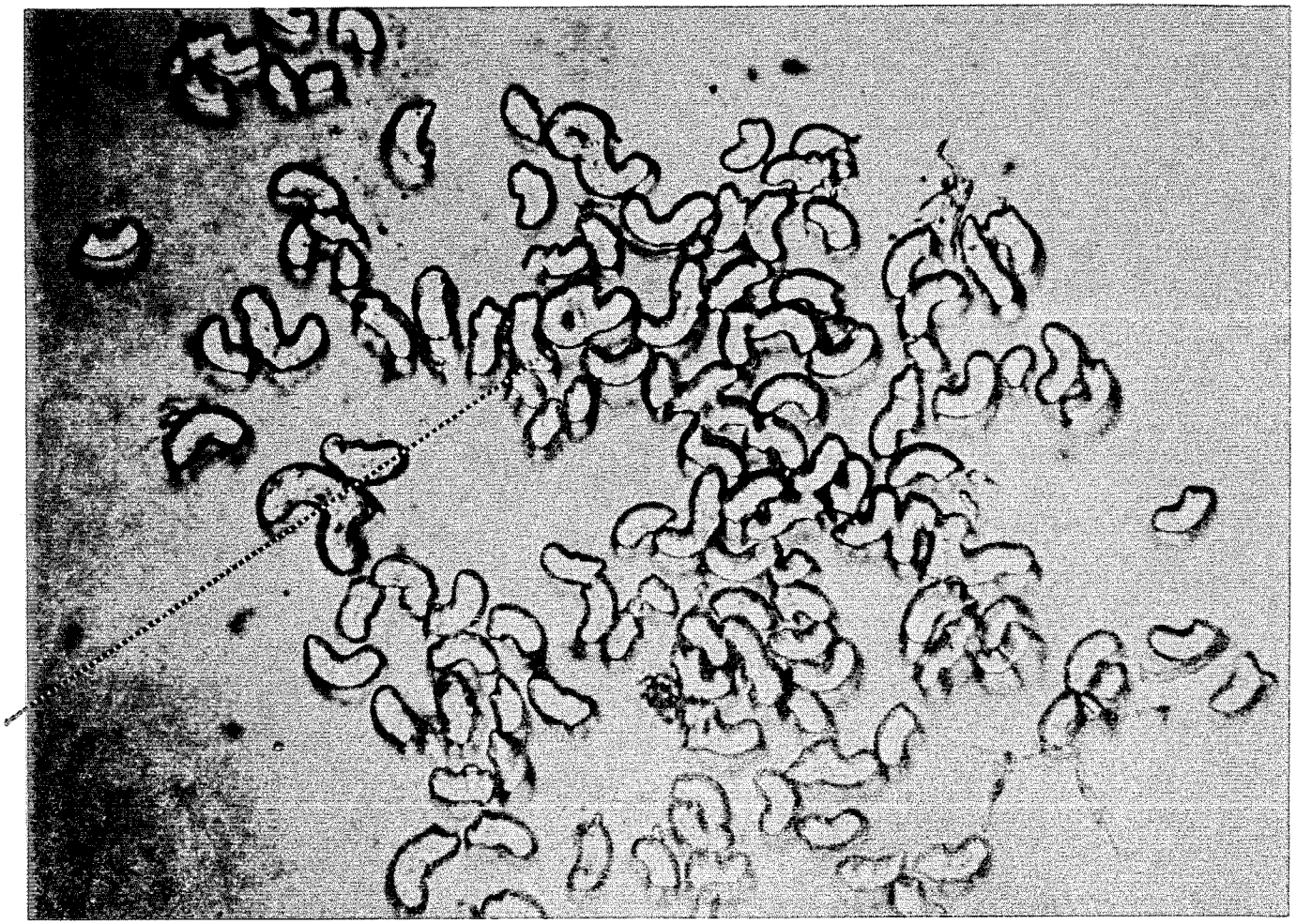
FIG. 10 is a photomicrograph of a cross section of a yarn of the invention.
Figure 11:
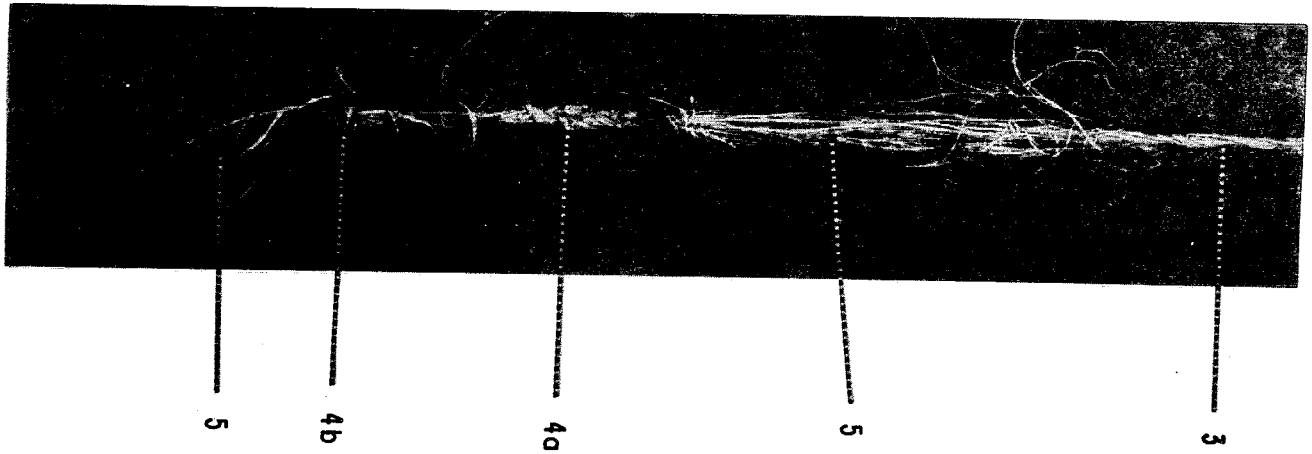
FIGS. 11–13 are photomicrographs of longitudinal sections of a yarn of the invention at progressively higher magnifications.
Figure 12:
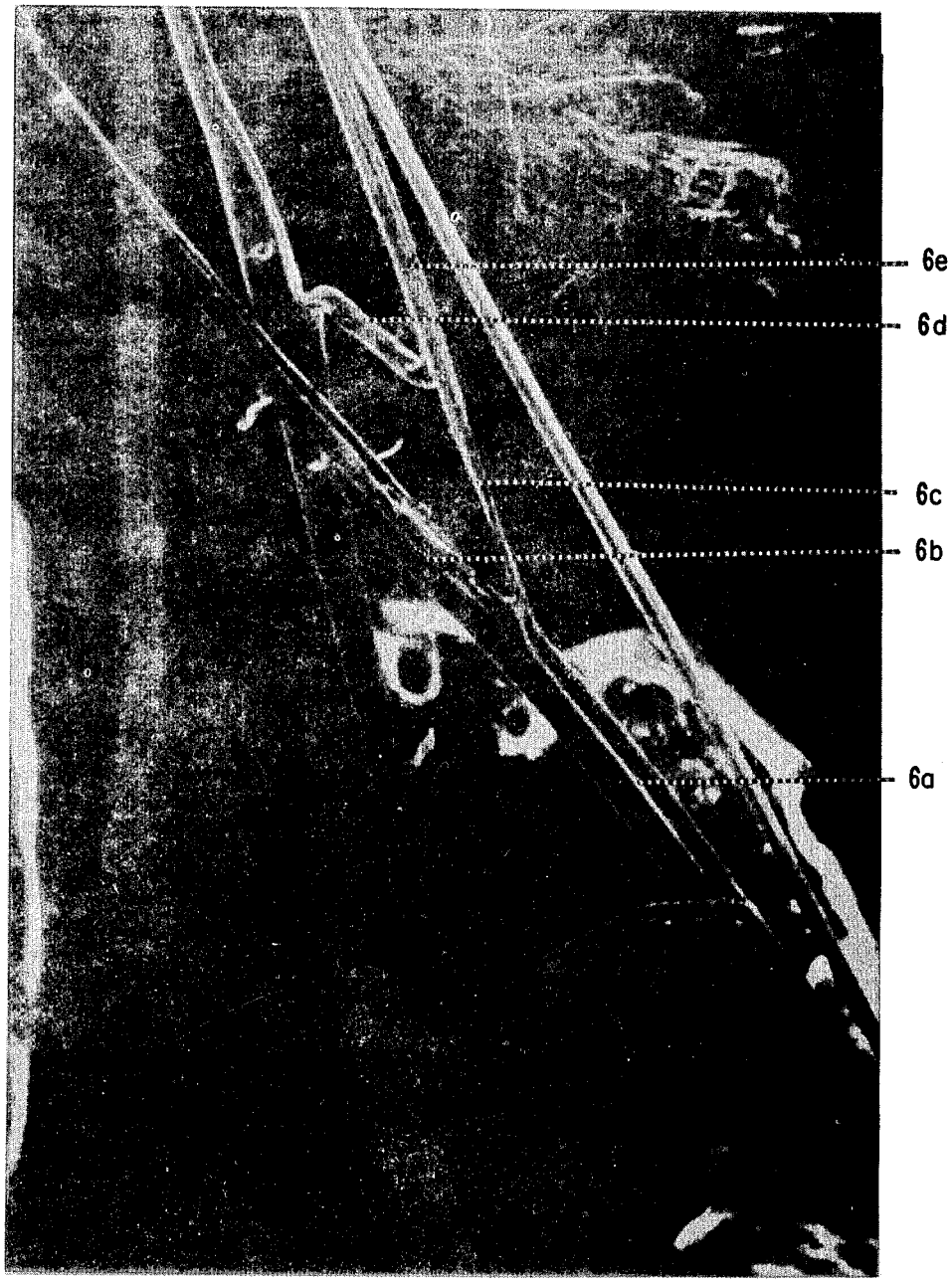
Figure 13:
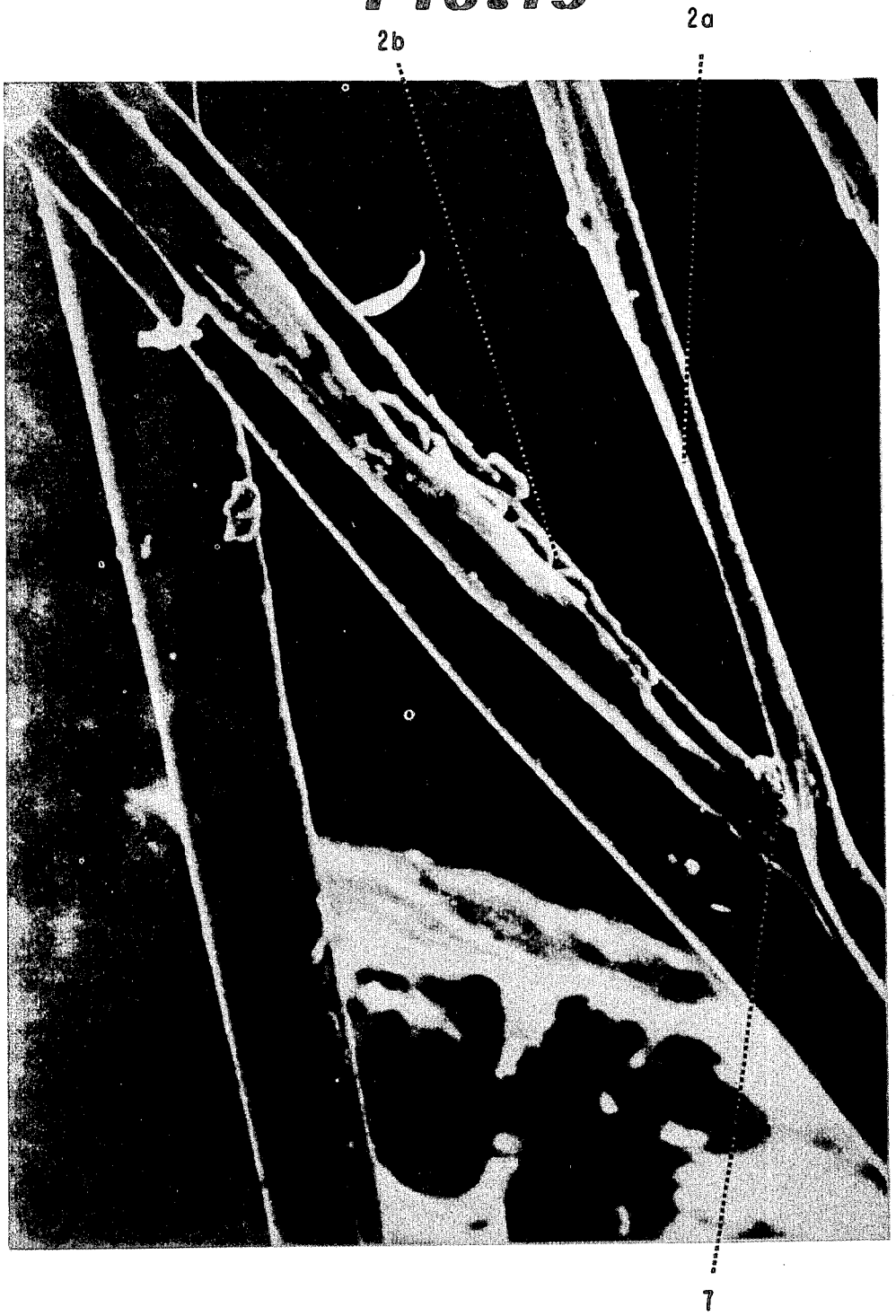

The textured yarn so produced was a soft, supple, spunlike yarn. It has a linear density of 11.6 tex (104.5 denier), a tenacity of 0.173 N/tex (1.96 gpd), an elongation of 5.6%, and a skein strength of 0.106 N/tex (Lea Product of 2256). The spunlike textured yarn was found to have 39 free ends per cm when examined by Test III. FIGS. 11–13 are scanning electron microscope photomicrographs of longitudinal sections of the textured yarn of Example I, suitable for use in examining the yarn in accordance with Test I. FIG. 11 is a photomicrograph of the yarn taken at 30× magnification, illustrating large free end 1 emanating from the entangled textured yarn 3 which has consolidated sections at node 4a and wraps 4b and has splayed sections 5. FIG. 12 is a photomicrograph of the same yarn taken at 300× magnification, illustrating (viewed vertically upwards) fibrous element 6a forking into fibrous elements 6b and 6c, while fibrous element 6d then merges with 6c to form fibrous element 6e. FIG. 13 is a photomicrograph of the same yarn taken at 1000×, illustrating ragged edges 2a and 2b at fork 7. When examined by Test II, 121 fibrous elements were seen, and 120 of these were matched up with free ends by following the procedure of part E(1) of Test II. One fibrous element was found in accordance with Test II, part E(8), that did not have a matching free end. This fibrous element resulted from a coalesced filament which can be seen as cross section 10A in FIG. 10, which is a portion of the Reference Photomicrograph for Example 1. The original coalesced feed yarn filament cross section can be seen in FIG. 9 as cross section 8. Cross section 9 is a normal feed yarn filament cross section.

A 28-cut interlock circular fabric was knitted from the textured yarn, feeding it at 826 cm (325 in) per revolution with a 3-needle delay ("Fouquet 28 Cut SMHH" 2640-needle double knit machine, manufactured by Fouquetwerk-Franz u. Planck, Rottenburg/Neckar, Germany). The knitted fabric was scoured, dyed at 121° C. in a pressure beck for one hour, dried at 121° C. for 30 seconds, and heat set at 171° C. for 60 seconds. The fabric was found to have 30-minute pill ratings of 3.2 and 3.7 on its face and back, respectively, and had a fabric weight of 143 g/m$^2$ (4.23 oz/yd$^2$).

Water may be used as the fluid-jet-texturing medium in the preparation of the spunlike yarns of the invention. Typical of such a product is a spunlike yarn made by water-jet-texturing a yarn like the feed yarn of Example I and having 28 free ends per cm when examined by Test III.

EXAMPLE II

Figure 2:
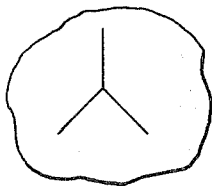
FIGS. 2–8 are spinneret orifices suitable for use in producing filaments that can be treated by the process herein set forth to produce the yarns of the present invention.
Figure 3:
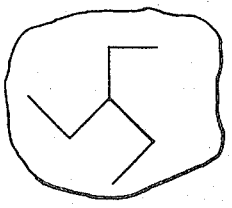
Figure 4:
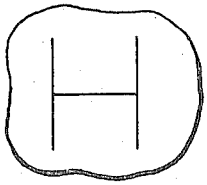
Figure 5:
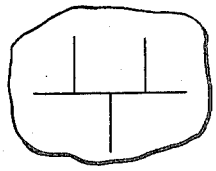

Poly(ethylene terephthalate/sodium 5-sulfoisophthalate) (98/2 mol ratio) having an HRV of about 17 was spun at a spinneret temperature of 270° C. from a 33-hole spinneret, each hole consisting of a Y-shaped orifice as shown in FIG. 2, formed by the intersections at 120 degree angles of three slots measuring 0.076 mm (3 mils) in width×0.76 mm (30 mils) in length, the end of each slot being enlarged by a round hole of 0.0635 mm (2.5 mil) radius having its center on the centerline of the slot. One slot of each orifice pointed directly towards the source of the cross-flow quenching air. The extruded filaments were gathered by guides into a yarn, passed from a pair of feed rolls at a peripheral speed of 1246 mpm (1363 ypm) through a steam jet at 220° C. to a pair of annealing draw rolls in a box with an air temperature maintained at 144° C. and operated at a peripheral speed of 2560 mpm (2800 ypm), and forwarded by two additional pairs of rolls operated at peripheral speeds of 2564 mpm (2804 ypm) and 2567 mpm (2807 ypm), respectively, to a windup operated at a peripheral speed of 2516 mpm (2751 ypm). The 33-filament yarn so produced had a linear density of 6.4 tex (58 denier), a tenacity of 0.191 N/tex (2.17 gpd), and an elongation of 7.3%. The ratio of the length of the fins in the Y cross section of the drawn filaments to the width of the fins, as measured in a photomicrograph of the filament cross section, was 4:1. Three of these yarns were combined to form a single 99-filament feed yarn.

Figure 6:
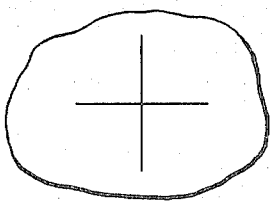

The 99-filament feed yarn was wetted with water and passed at a speed of 158 mpm (173 ypm) through the jet device of FIGS. 6 and 7 of U.S. Pat. No. 4,157,605, using the cylindrical baffle. The yarn needle exit 57 had an inside diameter of 0.051 cm (0.020 in), and at its narrowest point the diameter of the exit passage of venturi 58 was 0.178 cm (0.070 in). The overfeed was calculated as 6%. The jet device was supplied with air at 690 kPa (100 psi).

The yarn so produced was a soft, supple, spunlike yarn. It had a linear density of 20.2 tex (182 denier), a tenacity of 0.044 N/tex (0.50 gpd), an elongation of 2.6%, and a skein strength of 0.042 N/tex (Lea Product of 884). The spunlike yarn was found to have 84.2 free ends per cm when examined by Text III. The yarn was examined in accordance with Test I, and it was established that (1) the yarn was formed of a plurality of fibrous elements, (2) the fibrous elements forked and merged with one another, (3) ragged sides were visible on many of the fibrous elements, (4) there was frequent entanglement of the fibrous elements, and (5) some of the fibrous elements terminated as free ends. When the yarn was examined by Test II, all of the fibrous elements had matching free ends. A total of 813 fibrous elements were found in the Reference Photomicrograph.

A 22-cut interlock circular-knit fabric of the spunlike yarn was found to have a fabric weight of 191 g/m$^2$ (5.64 oz/yd$^2$), a thickness of 1 mm (0.038 in), and a bulk of 5.07 cc/gm. It had a 30-minute pill rating of 1.0.

EXAMPLE III

Delustered poly(ethylene terephthalate), having an HRV of about 23 and containing 0.3% $TiO_2$ as the delusterant, was spun at a spinneret temperature of 270° C. from a duplicate of the spinneret of Example I, which had 34 orifices. The delustered filaments were gathered by guides into a yarn, passed to a roll operating at a peripheral speed of 3000 mpm (3280 ypm), and wound up on a package at 2986 mpm (3266 ypm).

From an adjacent identical spinneret, clear poly(ethylene terephthalate), having an HRV of about 23 but containing no $TiO_2$, was extruded under identical conditions. One of the filaments from each of the adjacent spinnerets was then caused to cross over and be gathered together with the 33 other filaments from the adjacent spinneret, so that on the first side a yarn was gathered with 33 delustered filaments and one clear filament, while a yarn with 33 clear filaments and one delustered filament was wound on the second side.

The 34-filament yarn having 33 clear filaments and one delustered filament was passed from its windup package over a 1-meter (1.1-yd) long hot plate maintained at 150° C. to a draw roll operated at a peripheral speed of 208 mpm (228 ypm), the draw ratio being 1.4×, and thence at an overfeed of 5.7% through the jet device described in Example I. Air at a pressure of 1103 kPa (160 psig) was fed through the jet device.

The product was a spunlike yarn having a skein strength of 0.051 N/tex (Lea Product of 1085) when examined by Test III. The yarn was examined in accordance with Test I, and it was established that (1) the yarn was formed of a plurality of fibrous elements, (2) the fibrous elements forked and merged with one another, (3) ragged sides were visible on many of the fibrous elements, (4) there was frequent entanglement of the fibrous elements, and (5) some of the fibrous elements terminated as free ends. When the yarn was examined by Test II, a total of 76 fibrous elements were found in the Reference Photomicrograph and all of the fibrous elements had matching free ends. In an optical photomicrograph of the yarn taken at 100× magnification, fibrous elements containing delusterant could be clearly distinguished from fibrous elements made of clear polymer. The fibrous elements containing delusterant were seen to be in the form of a structure of forked and merged fibrous elements. FIG. 1 is a hand drawing of the structure containing delusterant, made while observing the yarn under a microscope at about 300×. The magnification and the focus of the microscope were changed as required from time to time while the drawing was being made so that the structural details could be clearly observed and recorded in the drawings.

EXAMPLE IV

The delustered polymer of Example I was spun at a spinneret temperature of 275° C. from a 34-hole spinneret in which 20 of the holes were circular, having a diameter of 0.038 cm (0.015 in). Of the other 14 holes, 7 had the configuration of FIG. 7 and 7 had the mirror image configuration, the dimensions of the holes being the same as in Example I, except that both the central arc and the outer arcs were slots 0.0084 cm (0.0033 in) wide. Cross-flow quenching air was passed across the extruded filaments in the same manner as Example I. The extruded filaments were gathered by guides into a yarn, passed to a roll operating at a peripheral speed of 3000 mpm (3281 ypm), and wound up on a package at the same speed. This yarn had a linear density of 19.4 tex (175 denier). The linear densities of the individual filaments in the yarn were 7.4 dtex (6.7 denier) for the filaments of round cross section and 4.5 dtex (4.1 denier) for the filaments extruded from the orifices having the configuration of FIG. 7 or its mirror image.

The 19.4 tex (175 denier) yarn was then passed from its windup package at a peripheral speed of 187 mpm (205 ypm) over a 1-meter (1.1-yd) long hot plate maintained at 160° C. to a draw roll operated at a peripheral speed of 300 mpm (328 ypm), passed through a jet device, around a roll operated at a peripheral speed of 285 mpm (312 ypm), then over a 1-meter (1.1-yd) long hot plate maintained at 210° C., and finally wound up on a package at 275 mpm (301 ypm). The jet device was like the jet identified as C-3 in Table Y of British Pat. No. 1,558,612.

Figure 14:
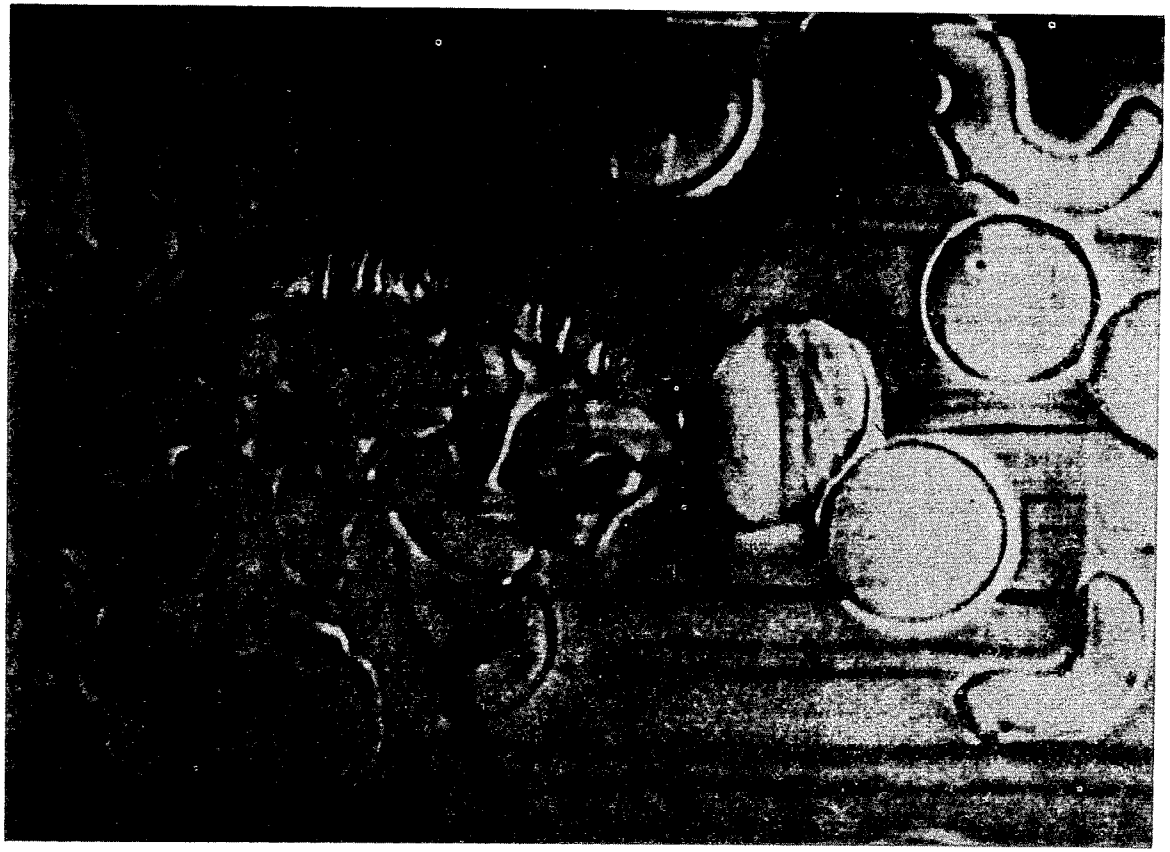
FIG. 14 is a photomicrograph of a cross section of a yarn of the invention containing companion members of round cross section.

The textured yarn so produced was a soft, supple, spunlike yarn. It was found to have 14.5 ends per cm when examined by Test III. It had a linear density of 13.2 tex (119 denier), a tenacity of 0.203 N/tex (2.30 gpd), an elongation of 10.3%, and a skein strength of 0.153 N/tex (Lea Product of 3256). A portion of the cross section of the yarn which had been embedded in epoxy resin is shown in FIG. 14. Visible in this cross section were intact companion members of round cross section as well as fibrous element cross sections derived from the splitting of filament cross sections spun from orifices having the configuration of FIG. 7 or its mirror image. In the complete yarn cross section, all 20 round companion members were seen.

A fabric was produced by knitting a tubing of the textured yarn (using a "Fiber Analysis Knitter," made by Lawson-Hemphill Southern, Inc., Spartanburg, S.C., at a stitch setting of 4.0 on a 54-gauge head). The knitted fabric was found to have a 30-minute pill rating of 2.8.

I claim:

1. A yarn consisting essentially of a plurality of synthetic fibrous elements having an irregular and varying cross section and being forked and merged in a fortuitous manner, the cross-sectional area and cross-sectional shape of each fibrous element changing along its length and some of said fibrous elements terminating in free ends, the cross-sectional area and cross-sectional shape of most of said fibrous elements being of approximately the same cross-sectional area and cross-sectional shape as those fibrous elements that terminate in free ends, and those fibrous elements that do not have approximately said area and said shape being forked to form fibrous elements of approximately said area and said shape, many of said fibrous elements having at least one ragged side that extends longitudinally of the fibrous elements, the fibrous elements being frequently entangled along the length of the yarn, said yarn having 10 to 150 free ends per centimeter of yarn length.

2. The yarn of claim 1 wherein the fibrous elements are entangled to the degree that the yarn has consolidated sections and splayed sections.

3. The yarn of claim 1 containing up to 90% by weight fibrous elements that extend at least substantially continuously throughout the length of the yarn, said yarn having consolidated sections and splayed sections.

4. The yarn of claim 3 in which the fibrous elements that extend at least substantially continuously throughout the length of the yarn have smooth sides.

5. The yarn of claim 3 in which the fibrous elements that extend at least substantially continuously throughout the length of the yarn, are forked and merged.

6. The yarn of claim 5 in which the fibrous elements that extend at least substantially continuously throughout the length of the yarn has a substantially continuous body portion and a wing portion that is occasionally split from the body portion, said wing portion occasionally ending in a free end.

7. The yarn of claim 1 in which some of the fibrous elements at least occasionally merge to form a fibrous element having the cross-sectional shape of a "C" or having a cross-sectional shape that requires more than four straight lines to trace its perimeter.

8. The yarn of claim 7 in which some of the fibrous elements at least occasionally merge to form a fibrous element having a "T," "X," "Y" or "V" cross-sectional shape.

* * * * *